US005546712A

United States Patent [19]

Bixby

[11] Patent Number: 5,546,712

[45] Date of Patent: Aug. 20, 1996

[54] SYSTEM AND METHOD OF CONSTRUCTING A SKYLIGHT

[76] Inventor: Joseph A. Bixby, 9659 Forest La., Ste. C-205, Dallas, Tex. 75243

[21] Appl. No.: 333,626

[22] Filed: Nov. 3, 1994

[51] Int. Cl.[6] ..... E04D 13/03

[52] U.S. Cl. ..... 52/200; 52/22; 52/28; 52/220.8; 52/741.1; 52/745.15; 52/745.16; 126/623

[58] Field of Search ..... 52/200, 22, 28, 52/220.8, 741.1, 745.15, 745.16; 362/147, 171, 172, 173, 365, 366; 126/623

[56] References Cited

U.S. PATENT DOCUMENTS 3,012,375 12/1961 Wasserman ..... 52/200 X
4,114,186 9/1978 Dominguez ..... 52/28 X
4,339,900 7/1982 Freeman .
4,620,771 11/1986 Dominguez .
4,733,505 3/1988 Van Dame .
4,809,468 3/1989 Bareiss ..... 52/200 X
5,099,622 3/1992 Sutton .

*Primary Examiner*—Carl D. Friedman
*Assistant Examiner*—Christopher Todd Kent
*Attorney, Agent, or Firm*—Charlotte W. Catlett; Smith & Catlett, P.C.

[57] ABSTRACT

A system and method for natural light illumination of residential and commercial buildings. A tubular skylight, the system comprises a highly reflective tubular body positioned in the space between a building's roof and ceiling with a first end with a supporting lip attached to a roof assembly, and a second end attached to a ceiling assembly. The roof assembly further comprises a semi-spherical transparent globe and a molded roof mount with a tapered sleeve. The ceiling assembly comprises a semi-spherical, light diffusing cap and a molded ceiling mount with a straight sleeve. In a preferred embodiment of the system, the first end of the tubular body is inserted through the tapered sleeve and supported therein by a right angle supporting lip and the second end of the tubular body is positioned over the sleeve of the ceiling mount.

11 Claims, 3 Drawing Sheets

SYSTEM AND METHOD OF CONSTRUCTING A SKYLIGHT

BACKGROUND OF THE INVENTION

1. Field of the Invention

This invention relates to illumination of building interiors with natural light, and more particularly, to a skylight system and method of installation for use within residential and commercial buildings.

2. Description of Related Art

The use of skylight systems in building structures is well known in the art. Standard systems include skylights constructed in the traditional window frame style and the more recently developed tubular body style. Usually, the window frame style is more costly than the tubular style and requires structural changes to the building's ceiling and roof for proper installation. For these reasons, the movement in natural illumination with sunlight has been toward the less expensive, easier installed tubular skylight system. Such skylights typically include a system with a ceiling structure, a roof structure and a tubular body positioned therebetween. Tubular skylight systems are disclosed, for example, in U.S. Pat. Nos. 4,339,900; 4,733,505; and 5,099,622. These prior art skylight systems, however, fall short of completely satisfactory construction, durability and efficient lighting. The shortcomings of these systems include use of non-sturdy materials, leaking roof mounts, external electrical ceiling light mounts and above-roof reflectors which may actually decrease the amount of sunlight emitted into the building's interior.

For example, in U.S. Pat. No. 5,099,622, issued to Steven M. Sutton on Mar. 31, 1992, the skylight system requires the use of a reflector located within the light-permeable chamber and mounted above the roof line. Even when strategically positioned along the path of the sun, the use of an above roof reflector blocks a significant portion of the sunlight which would otherwise enter the system and illuminate the building if the reflector were not present.

Notwithstanding the tubular skylight systems that have been previously disclosed, however, there remains a need for an inexpensive, leak proof, efficient natural light system that is aesthectically pleasing, easy to install and simple to maintain.

SUMMARY OF THE INVENTION

According to the present invention, a skylight illumination system is disclosed that comprises a roof assembly, a ceiling assembly and a tubular body positioned therebetween. The roof assembly comprises a low roofing mount and a transparent light penetrating globe. The roofing mount preferably comprises a cylindrical sleeve centrally located on a rectangular base. In a preferred embodiment, the cylindrical sleeve has a centrally disposed tapered step and defines a cylindrical aperture with a larger diameter below the taper than the diameter of the sleeve portion above the taper. The roofing mount is partly inserted under the shingles and anchored to the roof. The transparent globe is inserted over the upper sleeve portion and rests on the tapered step of the cylindrical sleeve. The ceiling assembly comprises a ceiling mount with a centrally located cylindrical sleeve and a light permeating cap attached thereto. The sleeve of the ceiling mount is inserted through the ceiling and extends into the space below the building's roof.

In one preferred embodiment, the tubular body comprises two elbow joints. Each elbow section of the body is cylindrically shaped, open at each end and constructed of a highly reflective material. According to a preferred embodiment of the invention, the elbow joints telescope together and can be repositioned to facilitate easy construction of skylight systems where the roof assembly and ceiling assembly are not oppositely opposed to each other. The upper elbow joint has a supporting lip at one end and a straight edge at the other and is inserted through the sleeve of the roof mount so that the supporting lip rests upon the upper edge of the roof mount's sleeve between the roof mount and the transparent globe. The second elbow joint has two straight ends, where one straight end telescopes over the straight edge of the first elbow joint and the other straight edge is positioned over the cylindrical sleeve of the ceiling mount.

According to another embodiment of the invention, the length of the tubular body is varied with the addition of one or more highly reflective cylindrical tubes which are also telescopically connected to the elbow joints, and each other, if applicable. In another embodiment of the invention, the tubular body has an additional cylindrical section, comprising a reflective extension arm for housing an electrical lighting assembly. In a preferred embodiment of the invention, the extension arm is located below the second elbow joint and is shaped as a gradually tapering cylinder with a circular opening at each end. Specifically, the lower circular opening is of a greater diameter than the upper circular opening. In addition, a lighting assembly is secured within the extension arm at the upper circular opening.

In another preferred embodiment, the method of home installation is disclosed comprising the steps of marking the location for an opening in each of a roof and a ceiling of a building structure; removing a section of the roof and ceiling materials to create an opening; inserting and securing the roof and ceiling assemblies in the respective openings, assembling a tubular body with an upper end and a lower end; inserting the upper portion of the tubular body through the roof assembly; positioning the lower portion of the tubular body over the sleeve of the ceiling assembly mount; connecting the upper and lower portions of the tubular body together; and sealing the connection points of each section of the skylight system. In another embodiment of the method of the invention, the lower portion of the tubular body comprises a gradually tapered cylindrical shaped reflective extension arm for housing an electrical lighting assembly with a circular opening at each end and a lighting assembly secured within the extension arm at the upper circular opening.

BRIEF DESCRIPTION OF THE DRAWINGS

The system and method of the invention are further described and explained in relation to the following figures of the drawings wherein.

DETAILED DESCRIPTION OF A PREFERRED EMBODIMENT

Figure 1:
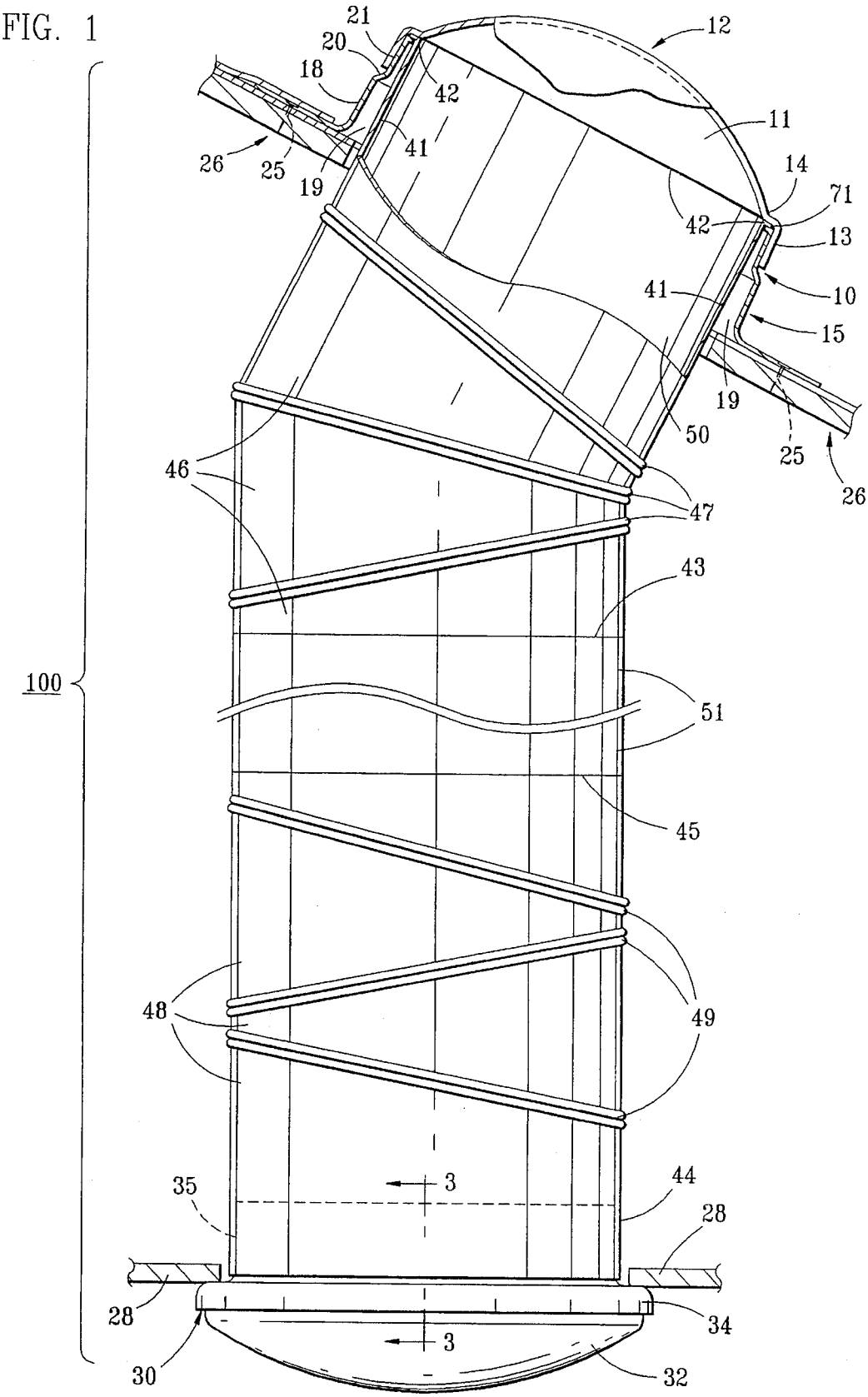
FIG. 1 is a simplified perspective view depicting a preferred embodiment of the invention.

As shown in FIG. 1, skylight illumination system 100 is disclosed and comprises a roof assembly 10, a ceiling assembly 30 and a tubular body 40 positioned therebetween. In a preferred embodiment of the invention, roof assembly 10 comprises a low roofing mount 15 and a transparent light collecting globe 12. Referring to FIGS. 1, 2, 4 and 5, roofing mount 15 comprises cylindrical sleeve 18 defining cylindrical aperture 19, upper opening 22 and lower opening 24. According to a preferred embodiment of the invention, roofing mount 15 further comprises rectangular base 16 extending outwardly from cylindrical sleeve 18 a distance sufficient to permit securing mount 15 between roof 26 and shingles 27. Cylindrical sleeve 18 further comprises tapered step 20, thereby defining lower sleeve portion 17 and opening 24 with a larger diameter than upper sleeve portion 21 and opening 22.

In a preferred embodiment, transparent globe 12 is preferably semi-spherically shaped, defining interior cavity 11, and further comprises a tapered step 14 above securing sleeve 13. To complete roof assembly 10, mount 15 is positioned over the opening in roof 26, with base 16 resting flush against roof 26 to pitched roof assembly 10 at the same angle as roof 26. Mount 15 is then secured to roof 26 with mounting hardware 25. After insertion of tubular body 40 as detailed below, sleeve 13 of globe 12 is positioned over sleeve 21 of mount 15, with edge 73 resting on tapered step 20 of mount 15. Hardware 25 is preferrably corrosive resistant standard mounting hardware such as screws or nails. Once system 100 is completely assembled, a sealant such as silicon is placed around the intersection of tapered step 20 and edge 73 and around the intersection of edge 72 of mount 15 and roof 26.

Ceiling assembly 30, as shown in FIGS. 1, 3, 6 and 7, comprises light permeating cap 32 and ceiling mount 34. In a preferred embodiment, light permeating cap 32 is semi-spherically shaped, defining interior cavity 31 below cap sleeve 33, and sleeve edge 74. Ceiling mount 34 is predominantly cylindrically shaped, defining ceiling mount interior 31. Ceiling mount 34 comprises mount sleeve 36 and extended sleeve section 35, with tapered step 37 therebetween, defining lower opening 39 at a diameter larger than upper opening 38, and sufficient to permit mount sleeve 36 to tightly slip over the exterior surface of sleeve 33 of light permeating cap 32. To complete ceiling assembly 30, sleeve 35 of mount 34 is inserted through the opening in ceiling 28 until sleeve 36 rests against ceiling 28. Mount 34 is then secured into position with mounting hardware 29. Sleeve 33 of cap 32 is then inserted into sleeve 36 of mount 34 until it snaps into position with edge 74 resting against the internal surface defined by tapered step 37.

Roofing mount 15 is preferably constructed from a durable, weather proof material such as a thermo-formed A.B.S. plastic. Globe 12 is preferably thermo-molded from a sturdy, durable material such as a transparent acrylic or other light penetrating material. Light permeable cap 32 preferably has a smooth, concave shaped exterior surface and a diamond-cut interior design and is molded from a light penetrable acrylic. Similarly, ceiling mount 34 is preferably constructed from a high luster A.B.S. plastic. It should be noted that other materials and methods of making roof assembly 10 and ceiling assembly 30 are known in the art and the suitability of such methods and materials for the unique design of the roof assembly of the invention can be easily determined by one of ordinary skill in the art according to the particular parameters of the design.

Referring back to FIG. 1, the tubular body 40 of skylight system 100 is preferably cylindrically shaped, defining aperture 50 and comprising upper elbow joint 46, lower elbow joint 48, and reflective interior surface 41. Dependant upon the actual system design and length, tubular body 40 further comprises one or more straight portions 50 connected in a telescoping manner to elbow joints 46, 48. Upper elbow joint 46 comprises rotation points 47, upper lip 42 and straight lower edge 43. Lower elbow joint 48 comprises rotation points 49, straight upper edge 45 and straight lower edge 44.

Tubular body 40 and the components thereof, 46, 48, 51 are constructed of a sturdy material with reflective properties or materials capable of having a reflective substance adhered thereto. For example, in the preferred embodiment, tubular body 40 is constructed of alumunium and interior surface 41 is a highly reflective surface such as highly polished or annodized aluminum. It should be noted that sturdy, durable materials such as plastics or metals other than aluminum may be used in the construction of tubular body 40. The actual materials used will be determined by one of ordinary skill in the art according to the particular parameters of the system design.

Figure 2:
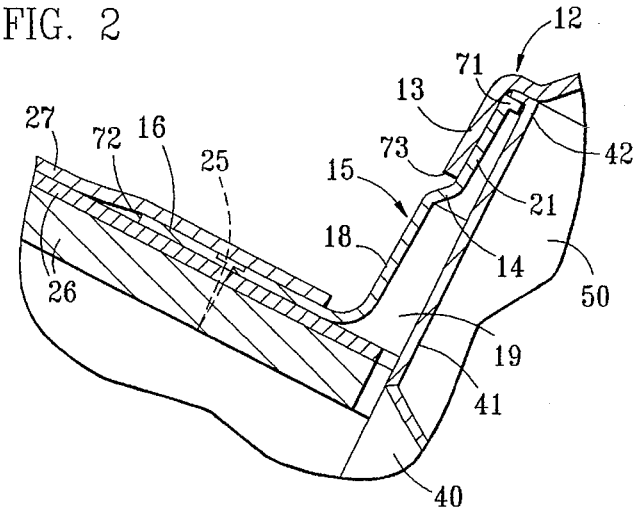
FIG. 2 is a detailed view of the roof assembly of the embodiment of the invention shown in FIG. 1, as secured to the roof of a building.
Figure 3:
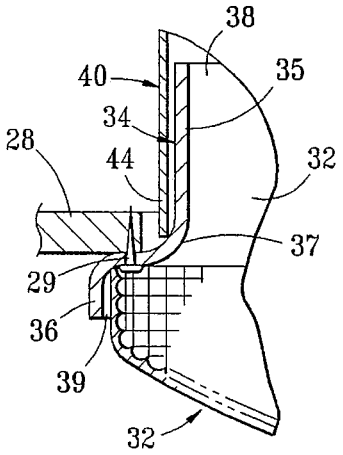
FIG. 3 is a detailed cross-sectional view of the ceiling assembly of the embodiment of the invention shown in FIG. 1, taken along line 3—3, as secured to the ceiling of a building.

As shown in FIGS. 1 and 2, upper elbow joint 46 is inserted through aperture 19 of roofing mount 15 until supporting lip 42 rests on and around upper edge 71 of roofing mount 15. Similarly, as shown in FIGS. 1 and 3, lower elbow joint 48 is positioned over sleeve 35 of ceiling mount 34 until edge 44 rests on tapered step 37. Thereafter, the angles of elbows 46, 48 are repositioned at rotation points 47, 49 and telescopically connected together at straight ends 43, 45. In an alternative embodiment, elbow joints 46, 48 have straight section 50 situated therebetween and connected telescopically at straight ends 43, 45.

Using skylight system 100, a room is naturally illuminated with sunlight which travels a reflective path from roof assembly 10, through tubular body 40, and into the room at ceiling assembly 30. Specifically, use of a low roof mount 15 pitched at the angle of roof 26 enables the maximum amount of sunlight permeating globe 12 into apertures 11, 19 to reach tubular body 40 without the additional use of reflectors. Sunlight which passes through apertures 11, 19, into interior 50, is reflected off the highly polished surface 41 into aperture 31 of ceiling mount 34, and then disbursed into the room through light permeating cap 32. At peak performance, the skylight system of the invention produces approximately 1000 footcandles of illumination, which is equivalent to 1400 watts of incandescent lighting.

Figure 8:
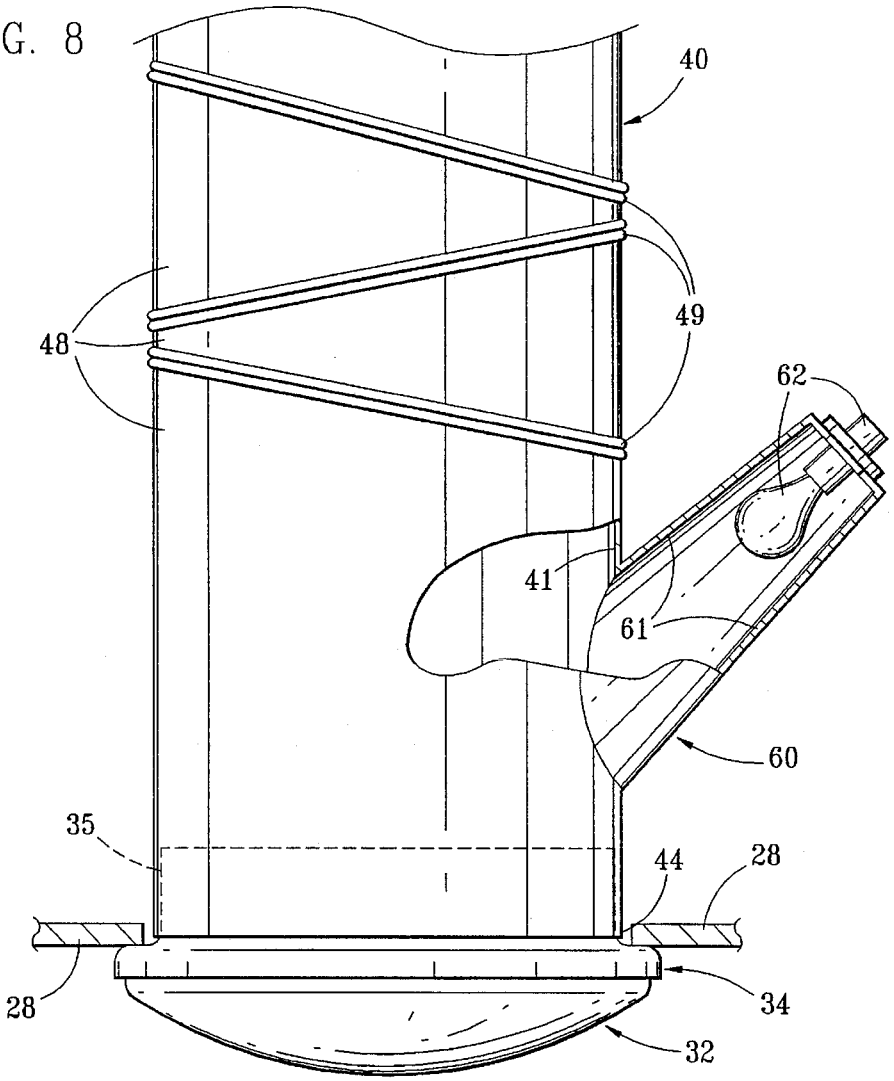
FIG. 8 is a simplified perspective view depicting the lower portion of an embodiment of the invention.
Figure 6:
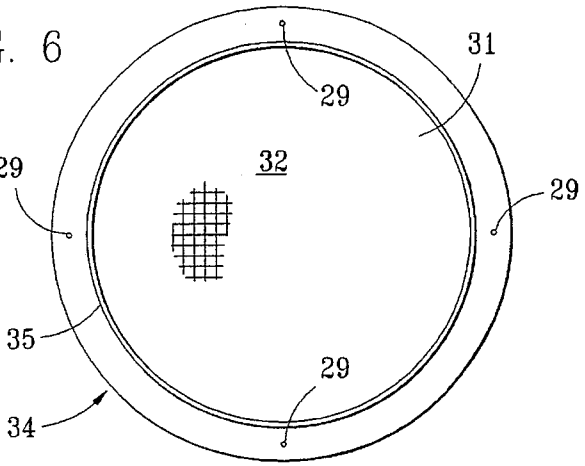
FIG. 6. is a plan view of the ceiling assembly of the embodiment of the invention shown in FIG. 1.
Figure 7:
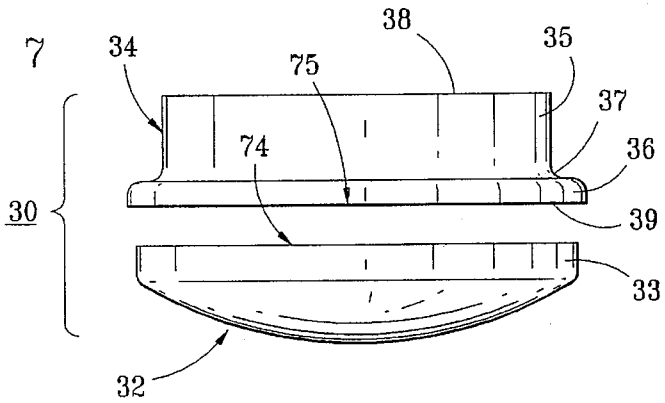
FIG. 7. is an exploded view of the ceiling assembly of the embodiment of the invention shown in FIG. 1.

In an alternative embodiment of the invention, as shown in FIG. 8, reflective extension arm 60, is shaped as a gradually tapering cylinder defining aperture 65 with lower end 66 at a larger diameter than upper end 67. Extension arm 60 further comprises highly reflective internal surface 61 and lighting assembly 62 positioned in aperture 65 at upper end 67. Lighting assembly 62 is preferrably a standard electrical lighting apparatus and can be used to illuminate the room's interior when natural illumination from sunlight is unavailable. Specifically, when needed, light from lighting assembly 62 bounces off reflective surfaces 61 and 41, following a path through ceiling mount aperature 32 and light cap 32 to illuminate the room.

Figure 4:
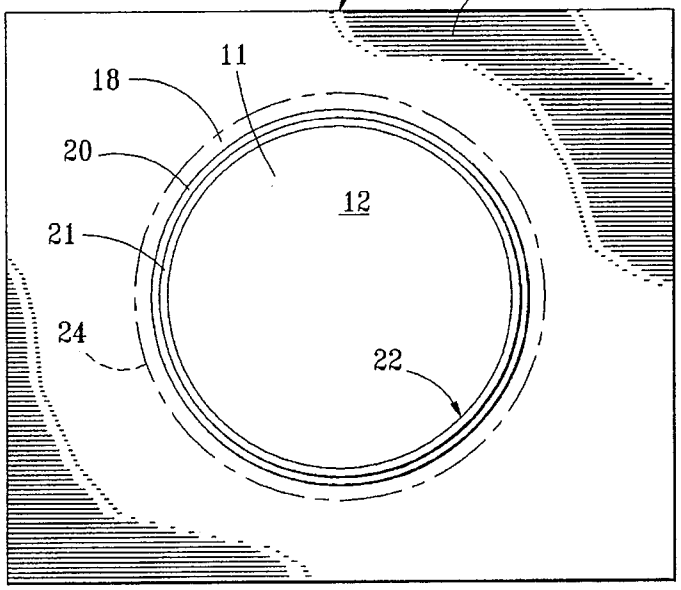
FIG. 4 is a plan view of the roof assembly of the embodiment of the invention shown in FIG. 1.
Figure 5:
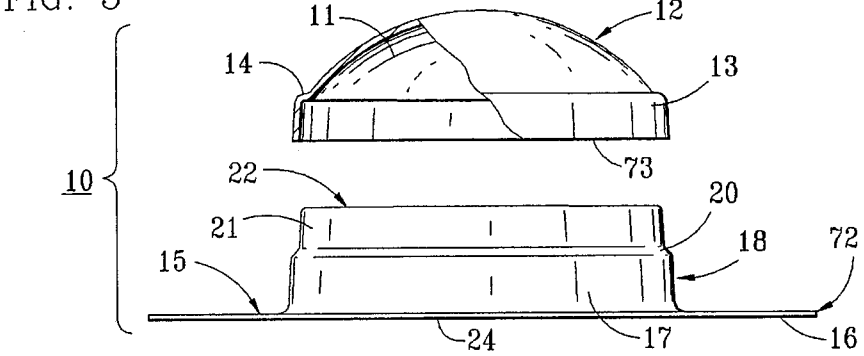
FIG. 5 is an exploded view of the roof assembly of the embodiment of the invention shown in FIG.1.

Construction and operation of the fully assembled skylight system 100 is best understood when considered within the scope of the method of the invention. Referring to FIGS. 1, 4 and 5, the method of the invention comprises the initial steps of marking the location for an opening in each of roof 26 and ceiling 28 of the building structure; identifying the number of tubular sections 46, 48 and 51 necessary to construct a tubular body 40 between the opening in roof 26 and ceiling 28; removing the marked sections of roof 26 and ceiling 28 to create the openings; inserting and securing the roof and ceiling assemblies 10, 30 in the respective openings; inserting the upper portion of the tubular body 40 through roof assembly 10; positioning the lower portion of tubular body 40 over ceiling assembly 30; connecting the upper and lower portions of tubular body 40 together; and sealing the connection points of each section of the skylight system.

Although the system and method of the invention has been described herein in relation to its preferred embodiments, other alterations and modifications of the invention will become apparent to those of ordinary skill in the art upon reading the present disclosure, and it is intended that the scope of the invention be limited only by the broadest interpretation of the claims to which the inventors are legally entitled.

I claim:

1. A skylight system for a building with a roof and a ceiling and a space therebetween, comprising:

a roof assembly having a roofing mount and a first light permeable cap, said roofing mount comprising a base and a cylindrical first sleeve defining a first aperature and having an upper end and a lower end;

a ceiling assembly having a ceiling mount and a second light permeable cap, said ceiling mount comprising a substantially cylindrical second sleeve having an upper sleeve section and a lower sleeve section and a first tapered step between said upper and lower sleeve sections; and a tubular body having a highly reflective interior surface and having a first end with a supporting lip and a straight second end; wherein said tubular body is inserted through said first aperture and suspended within said first aperture by resting said supporting lip on the upper end of said first sleeve and positioning said second end over said upper sleeve of said ceiling mount.

2. The skylight system of claim 1, wherein said supporting lip is at a right angle to the tubular body.

3. The skylight system of claim 1, wherein said tubular body further comprises a first elbow joint and a second elbow joint.

4. The skylight system of claim 3, wherein said first elbow joint is positioned above said second elbow joint.

5. The skylight system of claim 4, wherein said tubular body further comprises an electrical light arm positioned below said second elbow joint.

6. The skylight system of claim 3, wherein said first and second elbow joints telescope together.

7. The skylight system of claim 1, wherein said tubular body is constructed of aluminum.

8. The skylight system of claim 7, wherein said reflective internal surface is highly polished aluminum.

9. The skylight system of claim 7, wherein said reflective surface is annodized aluminum.

10. A method of constructing a skylight system in a building having a roof, a ceiling and a space therebetween, comprising the steps of:

determining the location for a first opening in said roof and a second opening in said ceiling;

removing sections of the roof and the ceiling to create said first and second openings;

securing a roof mount over said first opening; said roof mount comprising a base and a cylindrical first sleeve defining a first aperture and having an upper edge and a lower edge; wherein said roof mount base and lower edge of said cylindrical sleeve are positioned flush against said roof;

securing a ceiling mount over said second opening; said ceiling mount comprising a substantially cylindrical second sleeve having an upper sleeve section and a lower sleeve section and a first tapered step between said upper and lower sleeve sections; wherein said upper sleeve section extends through said opening in said ceiling; and positioning a tubular body having a first end with a supporting lip and a straight second end and a cylindrical body therebetween defining a second aperture, through the first aperture in said roofing mount; wherein the supporting lip rests on the upper edge of the cylindrical first sleeve and the upper sleeve section of the ceiling mount extends into the second aperture of the cylindrical body and the straight second end rests on said first tapered step of said ceiling mount.

11. The method of claim 10, further comprising the step of attaching a light arm between said supporting lip and said second straight end.

* * * * *